United States Patent [19]

Itsuki et al.

[11] Patent Number: 5,049,779

[45] Date of Patent: Sep. 17, 1991

[54] PHOSPHOR COMPOSITION USED FOR FLUORESCENT LAMP AND FLUORESCENT LAMP USING THE SAME

[75] Inventors: Yuji Itsuki; Keiji Ichinomiya, both of Anan, Japan

[73] Assignee: Nichia Kagaku Kogyo K.K., Tokushima, Japan

[21] Appl. No.: 345,004

[22] Filed: Apr. 28, 1989

[51] Int. Cl.[5] ..... H01J 1/62

[52] U.S. Cl. ..... 313/486; 313/485; 313/487

[58] Field of Search ..... 313/485, 486, 487

[56] References Cited

U.S. PATENT DOCUMENTS 4,431,942 2/1984 Thornton ..... 313/487

FOREIGN PATENT DOCUMENTS 60-220547 11/1985 Japan .
63-244547 10/1988 Japan .
2003657 3/1979 United Kingdom .

OTHER PUBLICATIONS

ISE Lighting Handbook, 1984 Reference Volume, Kaufman & Christensen (editors) pp. 8-19-8-20; 8-3-9-8-41, illuminating Engineering Society of North America (1984).

*Primary Examiner*—Donald J. Yusko
*Assistant Examiner*—Diab Hamadi
*Attorney, Agent, or Firm*—Nixon & Vanderhye

[57] ABSTRACT

A phosphor composition and a lamp having a phosphor film formed of the composition. The composition contains red, green and blue luminescence components. The blue component emits blue light by the excitation of 253.7-nm ultraviolet light. It has a main luminescence peak wavelength of 460 to 510 nm, and a half width of the main peak of a luminescence spectrum of not less than 50 nm. The color coordinates of the luminescence spectrum of the blue component falls within a range of $0.15 \leqq x \leqq 0.30$ and of $0.25 \leqq y \leqq 0.40$ based on the CIE 1931 standard chromaticity diagram. The blue component has a spectral reflectance of not less 80% at 380 to 500 nm, assuming that a spectral reflectance of a smoked magnesium oxide film is 100%. The amount of the blue component, with respect to the total weight of the composition, is specified within a region enclosed with solid lines (inclusive) connecting coordinate points a (5%, 2,500 K), b (5% 3,500 K), c (45% 8,000 K) d (95% 8,000 K), e (95% 7,000 K) and f (65%, 4,000 K) shown in FIG. 1 which are determined in accordance with a color temperature of the luminescence spectrum of the phosphor composition.

12 Claims, 3 Drawing Sheets

PHOSPHOR COMPOSITION USED FOR FLUORESCENT LAMP AND FLUORESCENT LAMP USING THE SAME

BACKGROUND OF THE INVENTION

1. Field of the Invention

The present invention relates to a phosphor composition used for a fluorescent lamp and a fluorescent lamp using the same.

2. Description of the Related Art

Conventionally, an antimony-/manganese-coactivated calcium halophosphate phosphor is most widely used for a general illumination fluorescent lamp. Although a lamp using such a phosphor has a high luminous efficiency, its color rendering properties are low, e.g., a mean color rendering index Ra=65 at a color temperature of 4,300 K of the luminescence spectrum of the phosphor and a mean color rendering index Ra=74 at a color temperature of 6,500 K. Therefore, a lamp using such a phosphor is not suitable when high color rendering properties are required.

Japanese Patent Publication No. 58-21672 discloses a three component type fluorescent lamp as a fluorescent lamp having relatively high color rendering properties. A combination of three narrow-band phosphors respectively having luminescence peaks near 450 nm, 545 nm, and 610 nm is used as a phosphor of this fluorescent lamp.

One of the three phosphors is a blue luminescence phosphor including, e.g., a divalent europium-activated alkaline earth metal aluminate phosphor and a divalent europium-activated alkaline earth metal chloroapatite phosphor. Another phosphor is a green luminescence phosphor including, e.g., a cerium-/terbium-coactivated lanthanum phosphate phosphor and a cerium-/terbium-coactivated magnesium aluminate phosphor. The remaining phosphor is a red luminescence phosphor including, e.g., a trivalent europium-activated yttrium oxide phosphor. A fluorescent lamp using a combination of these three phosphors has a mean color rendering index Ra=82 and a high luminous efficiency.

Although the luminous flux of such a three component type fluorescent lamp is considerably improved compared with a lamp using the antimony-/manganese-coactivated calcium halophosphate phosphor, its color rendering properties are not satisfactorily high. In addition, since rare earth elements are mainly used as materials for the phosphors of the three component type fluorescent lamp, the phosphors are several tens times expensive than the antimony-/manganese-coactivated calcium halophosphate phosphor.

Generally, a fluorescent lamp using a combination of various phosphors is known as a high-color-rendering lamp. For example, Japanese Patent Disclosure (Kokai) No. 54-102073 discloses a fluorescent lamp using a combination of four types of phosphors, e.g., divalent europium-activated strontium borophosphate (a blue luminescence phosphor), tin-activated strontium magnesium orthophosphate (an orange luminescence phosphor), manganese-activated zinc silicate (green/blue luminescence phosphor), and antimony-/manganese-coactivated calcium halophosphate (daylight-color luminescence phosphor). In addition, a lamp having Ra>95 has been developed by using a combination of five or six types of phosphors. However, these high-color-rendering lamps have low luminous fluxes of 1,180 to 2,300 Lm compared with a fluorescent lamp using the antimony-/manganese-coactivated calcium halophosphate phosphor. For example, a T-10.40-W lamp using the antimony-/manganese-coactivated calcium halophosphate phosphor has a luminous flux of 2,500 to 3,200 Lm. Thus, the luminous efficiencies of these high-color rendering fluorescent lamps are very low.

SUMMARY OF THE INVENTION

It is an object of the present invention to provide a phosphor composition which is low in cost and high in color rendering properties and luminous efficiency, and a fluorescent lamp using this phosphor composition.

A phosphor composition of the present invention contains red, blue, and green luminescence components. The blue luminescence component contained in the phosphor composition of the present invention emits blue light by the excitation of 253.7-nm ultraviolet light. The main luminescence peak of the blue light is present between wavelengths 460 and 510 nm, and the half width of the main peak is 50 nm or more. The color coordinates of the luminescence spectrum of the blue component fall within the ranges of $0.15 \leqq x \leqq 0.30$ and of $0.25 \leqq y \leqq 0.40$ based on the CIE 1931 standard chromaticity diagram. Assuming that the spectral reflectance of a smoked magnesium oxide film is 100%, the spectral reflectance of the blue component is 80% or more at 380 to 500 nm. The mixing weight ratio of the blue luminescence component with respect to the total amount of the composition is specified within the region enclosed with solid lines (inclusive) in FIG. 1 in accordance with the color temperature of the luminescence spectrum of the phosphor composition. The mixing weight ratio is specified in consideration of the initial luminous flux, color rendering properties, and cost of the blue phosphor.

A fluorescent lamp of the present invention is a lamp comprising a phosphor film formed by using the above-described phosphor composition of the invention.

According to the phosphor composition of the present invention and the lamp using the same, by specifying a type and amount of blue luminescence phosphor in the composition, both the color rendering properties and luminous efficiency can be increased compared with the conventional general fluorescent lamps. In addition, the luminous efficiency of the lamp of the present invention can be increased compared with the conventional high-color-rendering fluorescent lamp. The color rendering properties of the lamp of the present invention can be improved compared with the conventional three component type fluorescent lamp. Moreover, since the use of a phosphor containing expensive rare earth elements used for the conventional three component type fluorescent lamp can be suppressed, and an inexpensive blue luminescence phosphor can be used without degrading the characteristics of the phosphor composition, the cost can be considerably decreased compared with the conventional three component type fluorescent lamp.

DETAILED DESCRIPTION OF THE PREFERRED EMBODIMENTS

According to the present invention, a low-cost, high-color-rendering, high-luminous-efficiency phosphor composition and a fluorescent lamp using the same can be obtained by specifying a blue luminescence component of the phosphor composition.

A composition of the present invention is a phosphor composition containing red, blue, and green luminescence components, and the blue luminescence component is specified as follows. A blue luminescence component used for the composition of the present invention emits blue light by the excitation of 253.7-nm ultraviolet light. The main luminescence peak of the blue light is present between wavelengths 460 and 510 nm, and the half width of the main peak is 50 nm or more, preferably, 50 to 175 nm. The color coordinates of the luminescence spectrum fall within the ranges of $0.10 \leqq x \leqq 0.30$ and of $0.20 \leqq y \leqq 0.40$ based on the CIE 1931 standard chromaticity diagram. Assuming that the spectral reflectance of a smoked magnesium oxide film is 100%, the spectral reflectance of light at wavelengths of 380 to 500 nm is 80% or more. In addition, the mixing weight ratio of the blue luminescence component with respect to the total amount of the composition is specified within the region enclosed with solid lines (inclusive) connecting coordinate points a (5%, 2,500 K), b (5%, 3,500 K), c (45%, 8,000 K), d (95%, 8,000 K), d (95%, 7,000 K), and f (65%, 4,000 K) in FIG. 1 (the color temperature of a phosphor composition to be obtained is plotted along the axis of abscissa, and the amount (weight%) of a blue component of the phosphor composition is plotted along the axis of ordinate).

Figure 3:
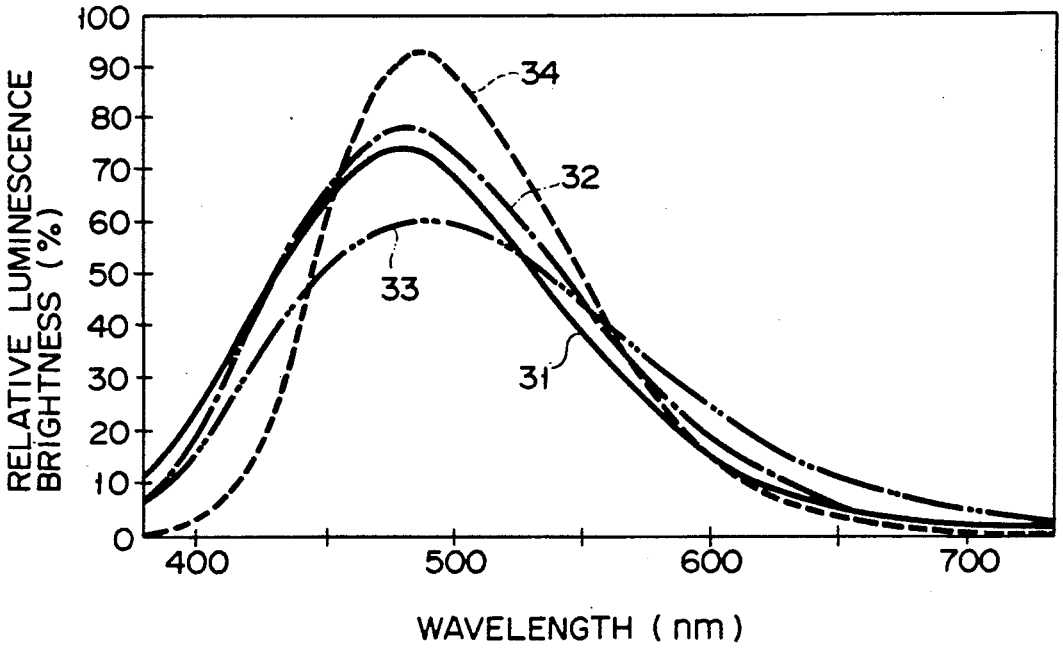
FIG. 3 is a graph showing the spectral luminescence characteristics of a blue luminescence phosphor used in the present invention.
Figure 4:
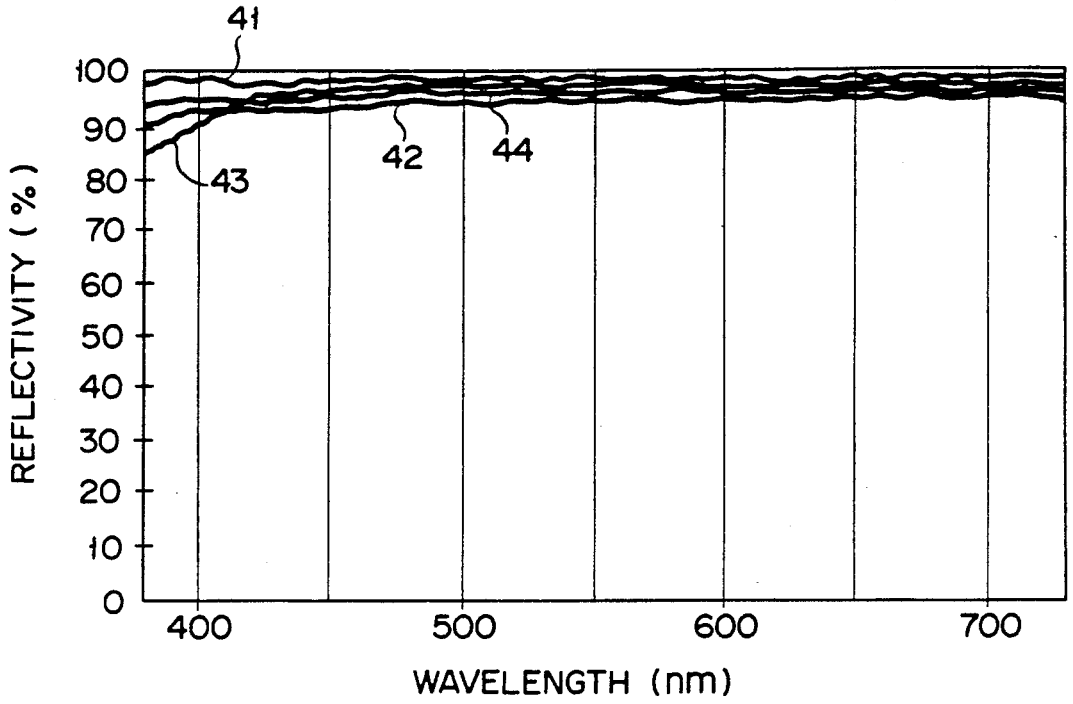
FIG. 4 a graph showing the spectral reflectance characteristics of a blue luminescence component used in the present invention.

As the blue luminescence component, for example, the following phosphors B1 to B4 are preferably used singly or in a combination of two or more:

(B1) an antimony-activated calcium halophosphate phosphor (B2) a magnesium tungstate phosphor (B3) a titanium-activated barium pyrophosphate phosphor (B4) a divalent europium-activated barium magnesium silicate phosphor FIG. 3 shows the spectral emission characteristics of the four phosphors, and FIG. 4 shows their spectral reflectances. In FIGS. 3 and 4, curves 31 and 41 correspond to the antimony-activated calcium halophosphate phosphor; curves 32 and 42, the magnesium tungstate phosphor; curves 33 and 43, the titanium-activated barium pyrophosphate phosphor; and curves 34 and 44, the divalent europium-activated barium magnesium silicate phosphor. As shown in FIG. 3, according to the spectral emission characteristics of the phosphors B1 to B4, the emission spectrum is very broad. As shown in FIG. 4, the spectral reflectances of the four phosphors are 80% or more at 380 to 500 nm, assuming that the spectral reflectance of a smoked magnesium oxide film is 100%.

In addition, a phosphor having a main peak wavelength of 530 to 550 nm and a peak half width of 10 nm or less is preferably used as the green luminescence phosphor. For example, the following phosphors G1 and G2 can be used singly or in a combination of the two:

(G1) a cerium-/terbium-coactivated lanthanum phosphate phosphor (G2) a cerium-/terbium-coactivated magnesium aluminate phosphor Moreover, a phosphor having a main peak wavelength of 600 to 660 nm and a main peak half width of 10 nm or less is preferably used as the red luminescence phosphor. For example, the following phosphors R1 to R4 can be used singly or in a combination of two or more:

(R1) a trivalent europium-activated yttrium oxide phosphor (R2) a divalent manganese-activated magnesium fluogermanate phosphor (R3) a trivalent europium-activated yttrium phosphovanadate phosphor (R4) a trivalent europium-activated yttrium vanadate phosphor The red and green luminescence components are mixed with each other at a ratio to obtain a phosphor composition having a desired color temperature. This ratio can be easily determined on the basis of experiments.

Table 1 shows the characteristics of these ten phosphors preferably used in the present invention.

TABLE 1

| Phosphor Classification | Sample | Name of Phosphor | Peak Wavelength | Half Width | Color Coordinate x | Color Coordinate y |
|---|---|---|---|---|---|---|
| First Phosphor | B1 | antimony-activated calcium holophosphate | 480 | 122 | 0.233 | 0.303 |
| | B2 | magnesium tungstate | 484 | 138 | 0.224 | 0.305 |
| | B3 | titanium-activated barium pyrophosphate | 493 | 170 | 0.261 | 0.338 |
| | B4 | europium-activated magnesium barium silicate | 490 | 93 | 0.216 | 0.336 |
| Second Phosphor | G1 | cerium-terbium-coactivated lanthanum phosphate | 543 | Line | 0.347 | 0.579 |
| | G2 | cerium-terbium-coactivated magnesium aluminate | 543 | Line | 0.332 | 0.597 |
| Third Phosphor | R1 | trivalent europium-activated yttrium oxide | 611 | Line | 0.650 | 0.345 |
| | R2 | divalent manganese-activated magnesium fluogermanate | 658 | Line | 0.712 | 0.287 |
| | R3 | trivalent europium-activated yttrium phosphovanadate | 620 | Line | 0.663 | 0.331 |
| | R4 | trivalent europium-activated yttrium | 620 | Line | 0.669 | 0.328 |

TABLE 1-continued

| Phosphor Classification | Sample | Name of Phosphor | Peak Wavelength | Half Width | Color Coordinate x | Color Coordinate y |
|---|---|---|---|---|---|---|
| | | vanadate | | | | |

Figure 2:
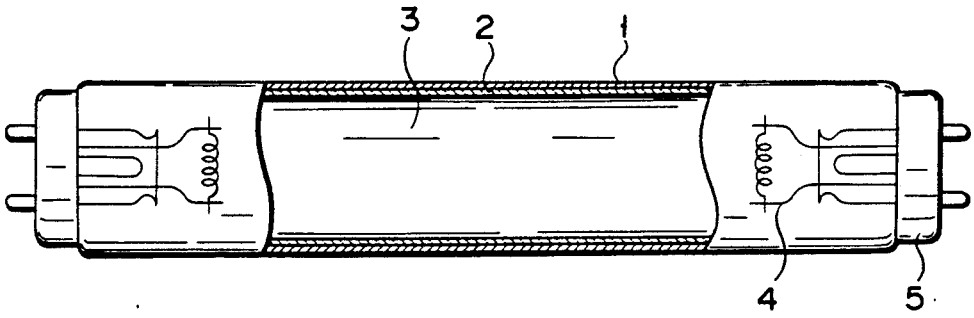
FIG. 2 is a view showing a fluorescent lamp according to the present invention.

A fluorescent lamp of the present invention has a phosphor film formed of the above-described phosphor composition, and has a structure shown in, e.g., FIG. 2. The fluorescent lamp shown in FIG. is designed such that a phosphor film 2 is formed on the inner surface of a glass tube 1 (T-10.40W) having a diameter of 32 mm which is hermetically sealed by bases 5 attached to its both ends, and electrodes 4 are respectively mounted on the bases 5. In addition, a seal gas 3 such as an argon gas and mercury are present in the glass tube 1.

EXAMPLES 1-60

A phosphor composition of the present invention was prepared by variously combining the phosphors B1 to B4, G1 and G2, and R1 to R4. The fluorescent lamp shown in FIG. 2 was formed by using this composition in accordance with the following processes.

100 g of nitrocellulose were dissolved in 9,900 g of butyl acetate to prepare a solution, and about 500 g of the phosphor composition of the present invention were dissolved in 500 g of this solution in a 1l-beaker. The resultant solution was stirred well to prepare a slurry.

Five fluorescent lamp glass tubes 1 were fixed upright in its longitudinal direction, and the slurry was then injected in each glass tube 1 to be coated on its inner surface. Thereafter, the coated slurry was dried. The mean weight of the coated films 2 of the five glass tubes was about 5.3 g after drying.

Subsequently, these glass tubes 1 were heated in an electric furnace kept at 600° C. for 10 minutes, so that the coated films 2 were baked to burn off the nitrocellulose. In addition, the electrodes 4 were respectively inserted in the glass tubes 1. Thereafter, each glass tube 1 was evacuated, and an argon gas and mercury were injected therein, thus manufacturing T-10.40-W fluorescent lamps.

A photometric operation of each fluorescent lamp was performed. Tables 2A and 2B show the results together with compositions and weight ratios. Table 3 shows similar characteristics of conventional high-color-rendering, natural-color, three component type, and general illumination fluorescent lamps as comparative examples.

TABLE 2A

| Example No. | Correlated Color Temperature (K) | Phosphor Mixing Weight Ratio: Blue B1 | Blue B2 | Blue B3 | Blue B4 | Green G1 | Green G2 | Red R1 | Red R2 | Red R3 | Red R4 | Initial Luminous Flux (Lm) | Mean Color Rendering Index (Ra)* |
|---|---|---|---|---|---|---|---|---|---|---|---|---|---|
| 1 | 2800 | 10 | | | | 26 | | 64 | | | | 3760 | 88 |
| 2 | 3000 | 12 | | | | 25 | | 63 | | | | 3720 | 88 |
| 3 | 3000 | 11 | | | | 24 | | 62 | | 3 | | 3680 | 88 |
| 4 | 3000 | 10 | | | | | 26 | 62 | 2 | | | 3670 | 88 |
| 5 | 4200 | 39 | | | | 21 | | 40 | | | | 3500 | 88 |
| 6 | 4200 | 37 | | | | | 22 | 41 | | | | 3480 | 88 |
| 7 | 4200 | 38 | | | | 20 | | 39 | 3 | | | 3470 | 89 |
| 8 | 4200 | 37 | | | | 19 | | 38 | 3 | 3 | | 3450 | 90 |
| 9 | 4200 | 38 | | | | 10 | 10 | 40 | 2 | | | 3470 | 89 |
| 10 | 4200 | 39 | | | | 10 | 11 | 36 | 4 | | | 3470 | 90 |
| 11 | 4200 | 37 | | | | | 21 | 39 | | 3 | | 3460 | 89 |
| 12 | 4200 | | 18 | | | 25 | | 57 | | | | 3620 | 89 |
| 13 | 4200 | | 17 | | | | 26 | 57 | | | | 3590 | 89 |
| 14 | 4200 | | 17 | | | 24 | | 56 | | 3 | | 3580 | 90 |
| 15 | 4200 | | 16 | | | | 23 | 54 | 7 | | | 3540 | 92 |
| 16 | 4200 | | 18 | | | 15 | 10 | 57 | | | | 3610 | 89 |
| 17 | 4200 | | | 49 | | 16 | | 35 | | | | 3530 | 89 |
| 18 | 4200 | | | 47 | | | 17 | 36 | | | | 3500 | 89 |
| 19 | 4200 | | | 47 | | 15 | | 33 | | 5 | | 3480 | 91 |
| 20 | 4200 | | | 48 | | 15 | | 33 | 4 | | | 3490 | 90 |
| 21 | 4200 | | | | 56 | 11 | | 33 | | | | 3550 | 91 |
| 22 | 4200 | | | | 54 | | 12 | 34 | | | | 3520 | 91 |
| 23 | 4200 | | | | 55 | 10 | | 32 | 3 | | | 3480 | 92 |
| 24 | 4200 | | | | 55 | 10 | | 32 | | 3 | | 3490 | 92 |
| 25 | 4200 | 20 | 9 | | | 23 | | 48 | | | | 3550 | 89 |
| 26 | 4200 | 20 | | 24 | | 18 | | 38 | | | | 3510 | 89 |
| 27 | 4200 | 20 | | | 28 | 16 | | 36 | | | | 3520 | 90 |
| 28 | 4200 | | 9 | 25 | | 20 | | 46 | | | | 3580 | 89 |
| 29 | 4200 | | 9 | | 28 | 18 | | 45 | | | | 3590 | 90 |
| 30 | 4200 | | | 24 | 28 | 14 | | 34 | | | | 3520 | 90 |

*Method of calculating Ra is based on CIE, second edition.

TABLE 2B

| Example No. | Correlated Color Temperature (K) | Phosphor Mixing Weight Ratio: Blue B1 | Blue B2 | Blue B3 | Blue B4 | Green G1 | Green G2 | Red R1 | Red R2 | Red R3 | Red R4 | Initial Luminous Flux (Lm) | Mean Color Rendering Index (Ra)* |
|---|---|---|---|---|---|---|---|---|---|---|---|---|---|
| 31 | 5000 | 55 | | | | 16 | | 29 | | | | 3280 | 90 |
| 32 | 5000 | 54 | | | | | 17 | 29 | | | | 3260 | 90 |
| 33 | 5000 | 53 | | | | 15 | | 27 | | 5 | | 3200 | 91 |

TABLE 2B-continued

| Example No. | Correlated Color Temperature (K) | Phosphor Mixing Weight Ratio | | | | | | | | | | Initial Luminous Flux (Lm) | Mean Color Rendering Index (Ra)* |
|---|---|---|---|---|---|---|---|---|---|---|---|---|---|
| | | Blue | | | | Green | | Red | | | | | |
| | | B1 | B2 | B3 | B4 | G1 | G2 | R1 | R2 | R3 | R4 | | |
| 34 | 5000 | 54 | | | | 15 | | 27 | 2 | | 2 | 3210 | 91 |
| 35 | 5000 | | 28 | | | 21 | | 51 | | | | 3440 | 91 |
| 36 | 5000 | | 27 | | | | 22 | 51 | | | | 3410 | 91 |
| 37 | 5000 | | 26 | | | 10 | | 49 | 3 | 3 | | 3360 | 93 |
| 38 | 5000 | | 27 | | | 19 | | 49 | 5 | | | 3380 | 92 |
| 39 | 5000 | | | 65 | | 9 | | 26 | | | | 3310 | 91 |
| 40 | 5000 | | | 63 | | | 10 | 27 | | | | 3290 | 91 |
| 41 | 5000 | | | 64 | | 8 | | 25 | 3 | | | 3280 | 92 |
| 42 | 5000 | | | 64 | | 8 | | 25 | | 3 | | 3290 | 92 |
| 43 | 5000 | | | 63 | | 5 | 3 | 24 | 3 | | 2 | 3270 | 93 |
| 44 | 5000 | | | | 62 | 8 | | 30 | | | | 3450 | 92 |
| 45 | 5000 | | | | 61 | | 9 | 30 | | | | 3420 | 92 |
| 46 | 5000 | | | | 62 | 4 | 5 | 27 | 2 | | | 3390 | 93 |
| 47 | 5000 | 27 | 14 | | | 10 | 9 | 40 | | | | 3350 | 91 |
| 48 | 5000 | 27 | | 32 | | 13 | | 28 | | | | 3290 | 91 |
| 49 | 5000 | 27 | | | 31 | 12 | | 30 | | | | 3370 | 91 |
| 50 | 5000 | 18 | 9 | 22 | | 15 | | 36 | | | | 3340 | 91 |
| 51 | 6700 | 70 | | | | 7 | | 23 | | | | 2980 | 91 |
| 52 | 6700 | 69 | | | | 4 | 3 | 19 | 3 | 2 | | 2950 | 93 |
| 53 | 6700 | | 42 | | | 13 | | 45 | | | | 3110 | 93 |
| 54 | 6700 | | 41 | | | 10 | 3 | 44 | 2 | | | 3080 | 94 |
| 55 | 6700 | | | 83 | | | | 17 | | | | 2920 | 91 |
| 56 | 6700 | | | | 82 | | | 18 | | | | 2960 | 93 |
| 57 | 6700 | 35 | 20 | | | 10 | | 35 | | | | 3050 | 92 |
| 58 | 6700 | | 20 | 42 | | 6 | | 32 | | | | 3010 | 92 |
| 59 | 6700 | | | 42 | 41 | | | 17 | | | | 2940 | 92 |
| 60 | 6700 | 23 | 14 | | 27 | 4 | 3 | 27 | 2 | | | 2980 | 94 |

TABLE 3

| Prior Art No. | Correlated Color Temperature (K) | Name of Lamp | Initial Luminous Flux (Lm) | Color Rendering Index (Ra)* |
|---|---|---|---|---|
| 1 | 5000 | High-color-rendering fluorescent lamp | 2250 | 99 |
| 2 | 3000 | High-color-rendering fluorescent lamp | 1950 | 95 |
| 3 | 6500 | Natural-color fluorescent lamp | 2000 | 94 |
| 4 | 5000 | Natural-color fluorescent lamp | 2400 | 92 |
| 5 | 4500 | Natural-color fluorescent lamp | 2450 | 92 |
| 6 | 5000 | Three component type fluorescent lamp | 3560 | 82 |
| 7 | 6700 | Three component type fluorescent lamp | 3350 | 82 |
| 8 | 3500 | General lighting fluorescent lamp | 3010 | 56 |
| 9 | 4300 | General lighting fluorescent lamp | 3100 | 65 |
| 10 | 5000 | General lighting fluorescent lamp | 2950 | 68 |
| 11 | 6500 | General lighting fluorescent lamp | 2700 | 74 |

*Method of calculating Ra is based on CIE second edition

As is apparent from Examples 1 to 60 shown in Table 2, each fluorescent lamp of the present invention has an initial luminous flux which is increased by several to 20% compared with those of most widely used general illumination fluorescent lamps, and has a mean color rendering index (87 to 94) larger than those of the conventional lamps (56 to 74) by about 20. Furthermore, although the mean color rendering index of each fluorescent lamp of the present invention is substantially the same as that of the natural-color fluorescent lamp (Ra=90), its initial luminous flux is increased by about 50%. In addition, although the mean color rendering index of each fluorescent lamp of the present invention is slightly lower than those of conventional high-color-rendering fluorescent lamps, its initial luminous flux is increased by about 50%.

It has been difficult to realize both high color rendering properties and initial luminous flux in the conventional fluorescent lamps. However, the fluorescent lamp of the present invention has both high color rendering properties and initial luminous flux. Note that each mean color rendering index is calculated on the basis of CIE, Second Edition.

Figure 1:
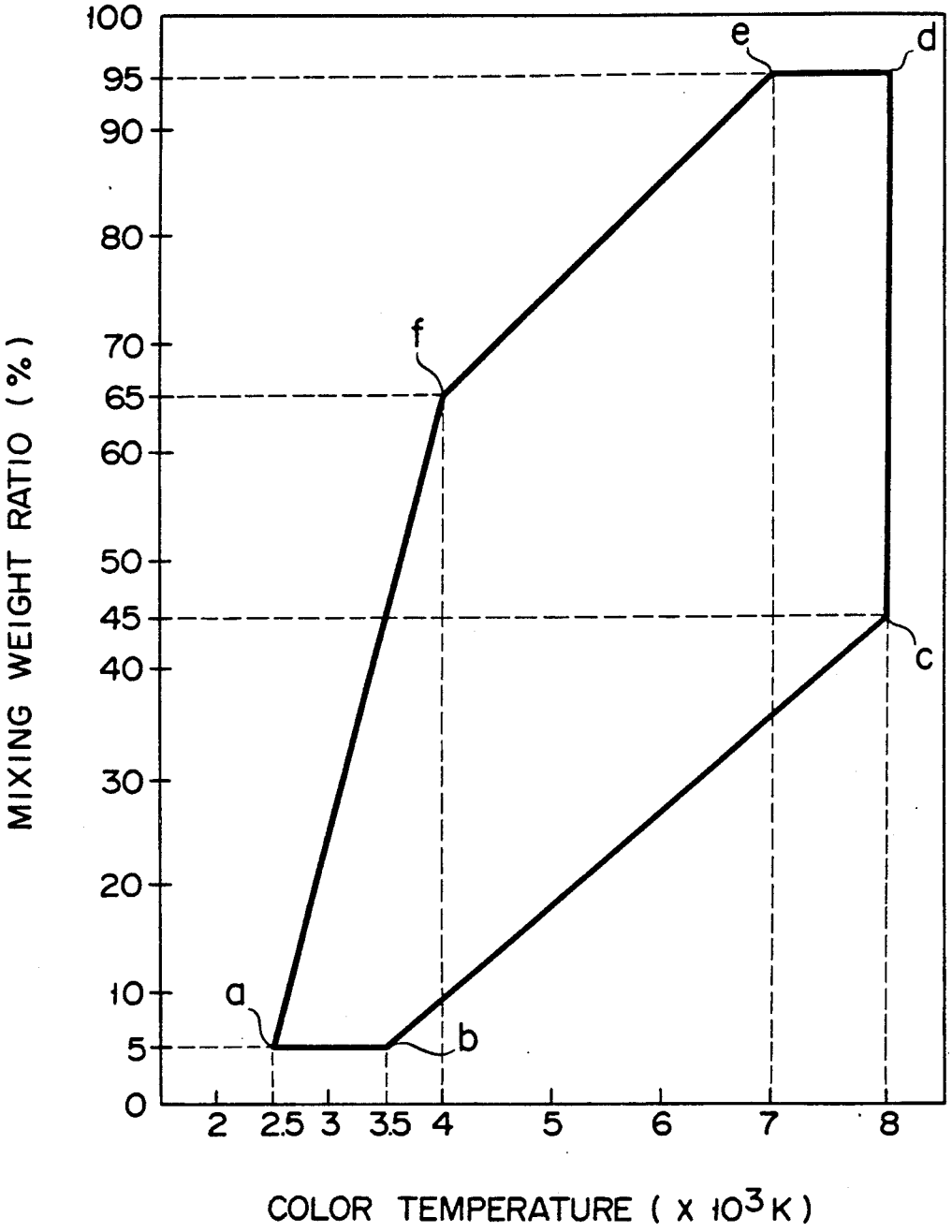
FIG. 1 is a graph showing the mixing weight ratio of a blue luminescence component used in the present invention.

According to the phosphor composition of the present invention and the fluorescent lamp using the same, the color temperature can be adjusted by adjusting the mixing weight ratio of a blue luminescence component. More specifically, if the mixing weight ratio of a blue luminescence component of a phosphor composition is decreased, and the weight ratio of a red luminescence component is increased, the color temperature of the luminescence spectrum of the phosphor composition tends to be decreased. In contrast to this, if the weight ratio of the blue luminescence component is increased, and the weight ratio of the red luminescence component is decreased, the color temperature tends to be increased. The color temperature of a fluorescent lamp is normally set to be in the range of 2,500 to 8,000 K. Therefore, according to the phosphor composition of the present invention and the fluorescent lamp using the same, the mixing weight ratio of a blue luminescence component is specified within the region enclosed with solid lines (inclusive) in accordance with a color temperature of 2,500 to 8,000 K, as shown in FIG. 1. Furthermore, according to the phosphor composition of the present invention and the fluorescent lamp using the same, in order to realize high luminous efficiency and color rendering properties, the main luminescence peak of a blue luminescence component, a half width of the main peak, and color coordinates x and y are specified. When the x and y values of the blue luminescence component fall within the ranges of $0.15 \leqq x \leqq 0.30$ and of $0.25 \leqq y \leqq 0.40$, high color rendering properties can be realized. If the main luminescence peak wavelength of the blue luminescence component is excessively large or small, excellent color rendering properties cannot be realized. In addition, if the half width of the main peak is smaller than 50 nm, excellent light output and high color rendering properties cannot be realized. Moreover, the spectral reflectance of the blue luminescence component of the present invention is specified to be 80% or more with respect to the spectral reflectance of a smoked magnesium oxide film at 380 to 500 nm so as to efficiently reflect luminescence and prevent absorption of luminescence by the phosphor itself. If a blue luminescence component having a spectral reflectance of less than 80% is used, a phosphor composition having good characteristics cannot be realized.

Figure 5:
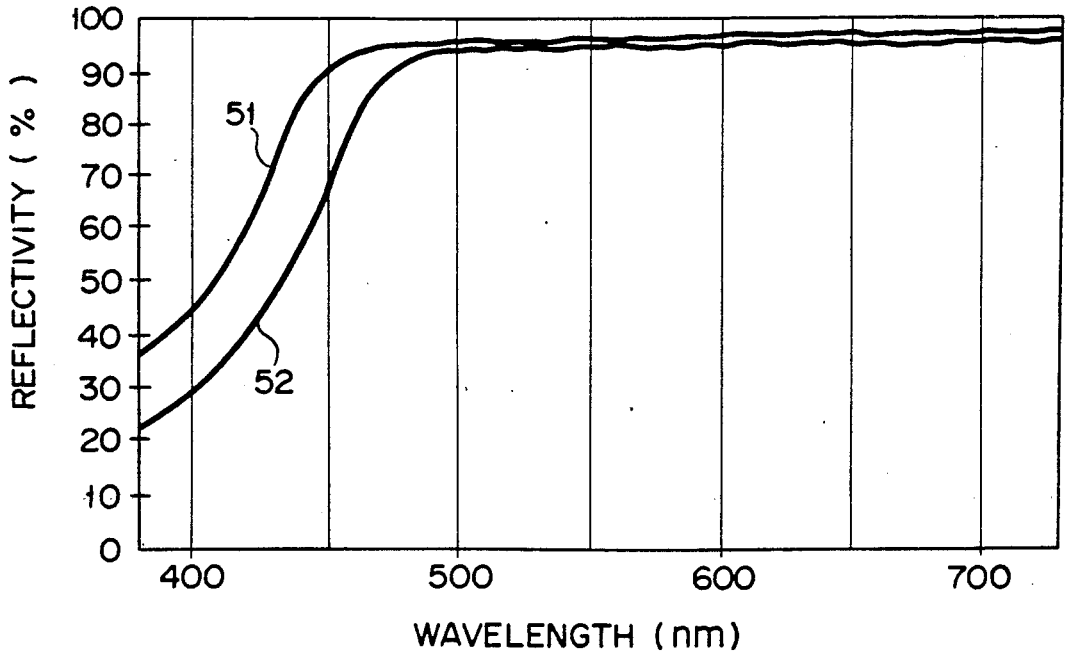
FIG. 5 is a graph showing the spectral reflectance characteristics of a blue luminescence phosphor which is not contained in the present invention.

As indicated by curves 41, 42, 43, and 44 in FIG. 4, an antimony-activated calcium halophosphate phosphor, a magnesium tungstanate phosphor, a titanium-activated barium pyrophosphate phosphor, and a divalent europium-activated barium magnesium silicate used in the present invention have reflectances corresponding to that of the blue luminescence component of the present invention. As indicated by curves 51 and 52 in FIG. 5, however, a divalent europium-activated strontium borophosphate phosphor (curve 51) and a divalent europium-activated strontium aluminate phosphor (curve 52) whose reflectances are decreased at 380 to 500 nm cannot be used as a blue luminescence phosphor of the present invention. As a blue luminescence component used in the present invention, inexpensive phosphors can be used in addition to phosphors containing rare earth elements such as europium.

Note that the composition of the present invention may contain luminescence components of other colors in addition to the above-described red, blue, and green luminescence components. For example, as such luminescence components, orange luminescence components such as antimony-/manganese-coactivated calcium halophosphate and tin-activated strontium magnesium orthophosphate, bluish green luminescence components such as manganese-activated zinc silicate and manganese-activated magnesium gallate, and the like can be used.

What is claimed is:

1. A phosphor composition for a low pressure mercury vapor lamp comprising:

a red luminescence component;

a green luminescence component; and a blue luminescence component which emits blue light by the excitation of 253.7-nm ultraviolet light and has a main luminescence peak wavelength of 460 to 510 nm, a half width of the main peak of a luminescence spectrum of not less than 50 nm, color coordinates of the luminescence spectrum falling within a range of $0.15 \leqq x \leqq 0.30$ and $0.25 \leqq y \leqq 0.40$ based on CIE 1931 standard chromaticity, and a spectral reflectance of not less 80% at 380 to 500 nm, when the spectral reflectance of a smoked magnesium oxide film is 100%, the mixing weight ratio of said blue luminescence component with respect to a total composition amount within the area defined by points a, b, c, d, e and f of FIG. 1, which points are determined according to the color temperature of the luminescence spectrum of said phosphor composition.

2. A composition according to claim 1, wherein a main luminescence peak wavelength of said green luminescence component falls within a range of 530 to 550 nm, and a half width of the peak is not more than 10 nm.

3. A composition according to claim 1, wherein a main luminescence peak wavelength of said red luminescence component falls within a range of 600 to 660 nm, and a half width of the peak is not more than 10 nm.

4. A composition according to claim 1, wherein said blue luminescence component contains at least one member selected from the group consisting of an antimony-activated calcium halophosphate phosphor, a magnesium tungstate phosphor, a titanium-activated barium pyrophosphate phosphor, and a divalent europium-activated barium magnesium silicate phosphor.

5. A composition according to claim 2, wherein a cerium/terbium-coactivated lanthanum phosphate phosphor and a cerium/terbium-coactivated magnesium aluminate phosphor are used as said green luminescence component singly or in combination.

6. A composition according to claim 3, wherein said red luminescence component contains at least one member selected from the group consisting of a trivalent europium-activated yttrium oxide phosphor, a trivalent europium-activated yttrium phosphovanadate phosphor, a trivalent europium-activated yttrium vanadate phosphor, and a divalent manganese-activated magnesium fluogermanate phosphor.

7. A low pressure mercury vapor lamp having a phosphor film containing a phosphor composition comprising:

a red luminescence component;

a green luminescence component; and a blue luminescence component which emits blue light by the excitation of 253.7-nm ultraviolet light and has a main luminescence peak wavelengths of 460 to 510 nm, a half width of the main peak of a luminescence spectrum of not less than 50 nm, color coordinates of the luminescence spectrum falling within a range of $0.15 \leqq x \leqq 0.30$ and $0.25 \leqq y \leqq 0.40$ based on CIE 1931 standard chromaticity, and a spectral reflectance of not less 80% at 380 to 500 nm, when the spectral reflectance of a smoked magnesium oxide film is 100%, the mixing weight ratio of said blue luminescence component with respect to a total composition amount within the area defined by points a, b, c, d, e and f or FIG. 1, which points are determined according to the color temperature of the luminescence spectrum of said phosphor composition.

8. A lamp according to claim 7, wherein a main luminescence peak wavelength of said green luminescence component falls within a range of 530 to 550 nm, and a half width of the peak is not more than 10 nm.

9. A lamp according to claim 7, wherein a main luminescence peak wavelength of said red luminescence component falls within a range of 600 to 660 nm, and a half width of the peak is not more than 10 nm.

10. A lamp according to claim 7, wherein said blue luminescence component contains at least one member selected from the group consisting of an antimony-activated calcium halophosphate phosphor, a magnesium tungstate phosphor, a titanium-activated barium pyrophosphate phosphor, and a divalent europium-activated barium magnesium silicate phosphor.

11. A lamp according to clam 8, wherein a cerium/-terbium-coactivated lanthanum phosphate phosphor and a cerium/terbium-coactivated magnesium aluminate phosphor are used as said green luminescence component singly or in combination.

12. A lamp according to claim 9, wherein said red luminescence component contains at least one member selected from the group consisting of a trivalent europium-activated yttrium oxide phosphor, a trivalent europium-activated yttrium phosphovanadate phosphor, a trivalent europium-activated yttrium vanadate phosphor,. and a divalent manganese-activated magnesium fluogermanate phosphor.

* * * * *